US009702148B2

(12) United States Patent
Zickell et al.

(10) Patent No.: US 9,702,148 B2
(45) Date of Patent: Jul. 11, 2017

(54) RUBBERIZED ROOF UNDERLAYMENT

(71) Applicant: Owens Corning Intellectual Capital, LLC, Toledo, OH (US)

(72) Inventors: Thomas J. Zickell, New Castle, NH (US); James A. Karlis, Pelham, NH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 347 days.

(21) Appl. No.: 14/247,306

(22) Filed: Apr. 8, 2014

(65) Prior Publication Data

US 2014/0220311 A1 Aug. 7, 2014

Related U.S. Application Data

(63) Continuation of application No. 12/692,084, filed on Jan. 22, 2010, now abandoned, which is a (Continued)

(51) Int. Cl.
*E04D 5/10* (2006.01)
*E04D 1/22* (2006.01)
(Continued)

(52) U.S. Cl.
CPC ..... *E04D 12/002* (2013.01); *E04D 1/22* (2013.01); *E04D 5/02* (2013.01); *E04D 5/10* (2013.01);
(Continued)

(58) Field of Classification Search
CPC E04D 12/002; E04D 1/22; E04D 5/10; E04D 5/02
See application file for complete search history.

(56) References Cited

U.S. PATENT DOCUMENTS 2,326,724 A 8/1943 George et al.
3,616,143 A 10/1971 Langlois
(Continued)

FOREIGN PATENT DOCUMENTS

WO 94/25180 11/1994
WO 98/31537 7/1998
(Continued)

OTHER PUBLICATIONS

Office action from U.S. Appl. No. 14/265,419 dated Jan. 12, 2016.
(Continued)

*Primary Examiner* — Cheng Huang
(74) *Attorney, Agent, or Firm* — Calfee, Halter & Griswold LLP

(57) ABSTRACT

An underlayment product comprises a fibrous mat having an upper surface and a lower surface. A rubberized asphalt coating is applied to the lower surface of the fibrous mat and extends at least partially into the fibrous mat. In one heavy-weight underlayment, an oxidized asphalt coating is applied to the upper and lower surfaces of the fibrous mat generally encapsulating the fibrous mat including the rubberized asphalt coating provided on the lower surface of the fibrous mat. The oxidized asphalt layers may be coated with a release layer such as talc, granules or a polymer. In a lightweight underlayment, a split release sheet or facer segmented to provide a releasable selvedge edge and incorporating a high traction polymer on its surface is applied to the rubberized asphalt.

8 Claims, 2 Drawing Sheets

Related U.S. Application Data continuation-in-part of application No. 11/238,371, filed on Sep. 29, 2005, now abandoned.

(51) Int. Cl.
*E04D 12/00* (2006.01)
*E04D 5/02* (2006.01)

(52) U.S. Cl.
CPC ..... *Y10T 428/24785* (2015.01); *Y10T 428/24793* (2015.01)

(56) References Cited

U.S. PATENT DOCUMENTS

| | | | |
|---|---|---|---|
| 3,622,445 | A | 11/1971 | Heidweiller |
| 3,753,826 | A | 8/1973 | Plummer |
| 3,759,736 | A | 9/1973 | Jenny et al. |
| 3,904,793 | A | 9/1975 | Priester, Jr. et al. |
| 4,138,521 | A | 2/1979 | Brown |
| 4,243,715 | A | 1/1981 | Gordon |
| 4,472,328 | A | 9/1984 | Sugimoto et al. |
| 4,490,493 | A | 12/1984 | Mikols |
| 4,522,673 | A | 6/1985 | Fell et al. |
| 4,636,414 | A | 1/1987 | Tajima et al. |
| 4,777,073 | A | 10/1988 | Sheth |
| 4,831,746 | A | 5/1989 | Kim et al. |
| 4,913,774 | A | 4/1990 | Goguelin |
| 4,943,465 | A | 7/1990 | Bailey et al. |
| 4,992,315 | A | 2/1991 | Zickell et al. |
| 5,038,693 | A | 8/1991 | Kourtides et al. |
| 5,102,728 | A | 4/1992 | Gay et al. |
| 5,280,064 | A | 1/1994 | Hesp et al. |
| 5,284,700 | A | 2/1994 | Strauss et al. |
| 5,308,692 | A | 5/1994 | Kennedy et al. |
| 5,401,588 | A | 3/1995 | Garvey et al. |
| 5,569,423 | A | 10/1996 | Belunova et al. |
| 5,601,629 | A | 2/1997 | Helbing |
| 5,654,060 | A | 8/1997 | Holman et al. |
| 5,658,972 | A | 8/1997 | Grzybowski et al. |
| 5,687,517 | A | 11/1997 | Wiercinski et al. |
| 5,813,176 | A | 9/1998 | Tzeng et al. |
| 5,916,654 | A | 6/1999 | Phillips et al. |
| 5,925,695 | A | 7/1999 | Ohtsuka et al. |
| 5,965,257 | A | 10/1999 | Ahluwalia |
| 5,972,166 | A | 10/1999 | Helwig et al. |
| 6,058,583 | A | 5/2000 | Takeuchi et al. |
| 6,171,443 | B1 | 1/2001 | Goettmann et al. |
| 6,235,364 | B1 | 5/2001 | Katsuro et al. |
| 6,267,843 | B1 | 7/2001 | Helwig et al. |
| 6,296,912 | B1 | 10/2001 | Zickell et al. |
| 6,308,482 | B1 | 10/2001 | Strait |
| 6,326,060 | B1 | 12/2001 | Ogawa |
| 6,365,001 | B1 | 4/2002 | Helwig et al. |
| 6,378,259 | B1 | 4/2002 | Carlson |
| 6,385,934 | B1 | 5/2002 | Zickell et al. |
| 6,497,787 | B1 | 12/2002 | Geel |
| 6,500,560 | B1 | 12/2002 | Kiik et al. |
| 6,517,676 | B1 | 2/2003 | Mathur |
| 6,531,200 | B2 | 3/2003 | Zickell et al. |
| 6,586,353 | B1 | 7/2003 | Kiik et al. |
| 6,641,896 | B2 | 11/2003 | Fensel et al. |
| 6,696,125 | B2 | 2/2004 | Zanchetta et al. |
| 6,720,067 | B2 | 4/2004 | Takahashi et al. |
| 6,811,649 | B2 | 11/2004 | Pfeffer |
| 6,844,057 | B2 | 1/2005 | Dichiara, Jr. |
| 6,844,091 | B2 | 1/2005 | Denham et al. |
| 6,925,766 | B2 | 8/2005 | DiPede |
| 6,968,662 | B2 | 11/2005 | Rodrigues |
| 7,115,313 | B2 | 10/2006 | Zanchetta et al. |
| 7,132,143 | B2 | 11/2006 | Zanchetta et al. |
| 7,140,153 | B1 | 11/2006 | Humphreys et al. |
| 7,537,820 | B2 | 5/2009 | Kalkanoglu |
| 7,563,733 | B2 | 7/2009 | Ahluwalia et al. |
| 7,634,877 | B2 | 12/2009 | Wiercinski |
| 7,836,654 | B2 | 11/2010 | Belt |
| 8,062,985 | B2 | 11/2011 | Collier |
| 8,178,449 | B2 | 5/2012 | LaVietes et al. |
| 2002/0081924 | A1 | 6/2002 | Fensel et al. |
| 2002/0092634 | A1 | 7/2002 | Rokman et al. |
| 2003/0054717 | A1 | 3/2003 | Ahluwalia |
| 2003/0099833 | A1 | 5/2003 | Erb, Jr. et al. |
| 2003/0109190 | A1 | 6/2003 | Geel |
| 2003/0148693 | A1 | 8/2003 | Erb, Jr. et al. |
| 2003/0175478 | A1 | 9/2003 | Leclercq |
| 2003/0176125 | A1 | 9/2003 | Ahluwalia |
| 2003/0224679 | A1 | 12/2003 | Ahluwalia |
| 2003/0228460 | A1 | 12/2003 | Ahluwalia |
| 2004/0016502 | A1 | 1/2004 | Jones |
| 2004/0038065 | A1 | 2/2004 | Francis et al. |
| 2004/0055240 | A1 | 3/2004 | Kiik et al. |
| 2004/0071927 | A1 | 4/2004 | Murphy et al. |
| 2004/0116022 | A1 | 6/2004 | Langley et al. |
| 2004/0148887 | A1 | 8/2004 | DiPede |
| 2004/0161569 | A1 | 8/2004 | Zanchetta et al. |
| 2004/0161570 | A1 | 8/2004 | Zanchetta et al. |
| 2005/0031843 | A1 | 2/2005 | Robinson et al. |
| 2005/0097857 | A1 | 5/2005 | Mehta et al. |
| 2005/0171223 | A1 | 8/2005 | Thagard, III et al. |
| 2005/0208851 | A1 | 9/2005 | Gooliak |
| 2006/0078753 | A1 | 4/2006 | Bomberg et al. |
| 2006/0118992 | A1 | 6/2006 | Chang et al. |
| 2006/0228963 | A1 | 10/2006 | Souther et al. |
| 2006/0286347 | A1 | 12/2006 | Mehta et al. |
| 2007/0044397 | A1 | 3/2007 | Wiercinski et al. |
| 2007/0044407 | A1 | 3/2007 | Elliott |
| 2007/0044410 | A1 | 3/2007 | Kalkanoglu |
| 2007/0071946 | A1 | 3/2007 | Zickell |
| 2007/0137130 | A1 | 6/2007 | Zickell et al. |
| 2007/0178784 | A1 | 8/2007 | Jones et al. |
| 2008/0014814 | A1 | 1/2008 | Geel |
| 2008/0155923 | A1 | 7/2008 | Teng et al. |
| 2008/0166533 | A1 | 7/2008 | Jones et al. |
| 2008/0227353 | A1 | 9/2008 | Klingelhage et al. |
| 2008/0233325 | A1 | 9/2008 | Pahl et al. |
| 2008/0286517 | A1 | 11/2008 | Zickell |
| 2008/0289289 | A1 | 11/2008 | Wiercinski et al. |
| 2009/0042471 | A1 | 2/2009 | Cashin et al. |
| 2009/0277126 | A1 | 11/2009 | Wollert et al. |
| 2010/0119784 | A1 | 5/2010 | Zickell |
| 2010/0233408 | A1 | 9/2010 | Zickell |
| 2011/0104461 | A1 | 5/2011 | Grubka |

FOREIGN PATENT DOCUMENTS

| | | |
|---|---|---|
| WO | 02/06605 | 1/2002 |
| WO | 2006/007168 | 1/2006 |
| WO | 2006/087426 | 8/2006 |
| WO | 2007/019399 | 2/2007 |

OTHER PUBLICATIONS

Office action from U.S. Appl. No. 11/238,371 dated Nov. 25, 2008.
Office action from U.S. Appl. No. 11/238,371 dated Apr. 28, 2009.
Interview Summary from U.S. Appl. No. 11/238,371 dated Jul. 22, 2009.
Office action from U.S. Appl. No. 11/238,371 dated Oct. 15, 2009.
Advisory action from U.S. Appl. No. 11/238,371 dated Jan. 27, 2010.
Office action from U.S. Appl. No. 11/238,371 dated Mar. 22, 2010.
Office action from U.S. Appl. No. 11/238,371 dated Oct. 20, 2010.
Office action from U.S. Appl. No. 11/238,371 dated Jun. 23, 2011.
Office action from U.S. Appl. No. 11/238,371 dated Dec. 15, 2011.
Advisory action from U.S. Appl. No. 11/238,371 dated Apr. 3, 2012.
Office action from U.S. Appl. No. 11/238,371 dated May 23, 2013.
Office action from U.S. Appl. No. 11/291,634 dated Dec. 22, 2008.
Interview Summary from U.S. Appl. No. 11/291,634 dated Aug. 4, 2009.
Office action from U.S. Appl. No. 12/692,084 dated Jul. 20, 2011.
Office action from U.S. Appl. No. 12/692,084 dated Nov. 10, 2011.
Office action from U.S. Appl. No. 12/692,084 dated May 23, 2013.
Office action from U.S. Appl. No. 12/692,084 dated Nov. 8, 2013.

(56) References Cited

OTHER PUBLICATIONS

Advisory Action from U.S. Appl. No. 12/692,084 dated Feb. 28, 2014.
Office action from U.S. Appl. No. 12/731,706 dated Aug. 20, 2010.
Office action from U.S. Appl. No. 12/731,706 dated Apr. 1, 2011.
Office action from U.S. Appl. No. 12/731,706 dated Jun. 14, 2012.
Office action from U.S. Appl. No. 12/731,706 dated Nov. 8, 2012.
Office action from U.S. Appl. No. 12/892,629 dated Apr. 24, 2013.
Office action from U.S. Appl. No. 12/985,072 dated Oct. 16, 2012.
International Search Report and Written Opinion from PCT/US08/57609 dated Jul. 1, 2008.
Office action from Canadian Application No. 2,550,172 dated Oct. 9, 2012.
Office action from U.S. Appl. No. 11/485,652 dated Jul. 13, 2006.
Office action from U.S. Appl. No. 11/927,268 dated Oct. 29, 2007.
Notice of Allowance from U.S. Appl. No. 14/265,419 dated Jun. 2, 2016.
Office action from Canadian Application No. 2,728,709 dated Jan. 11, 2017.

RUBBERIZED ROOF UNDERLAYMENT

CROSS-REFERENCE TO RELATED APPLICATIONS

This application is a continuation application of U.S. Ser. No. 12/692,084, filed Jan. 22, 2010, titled RUBBERIZED ROOF UNDERLAYMENT, which is a continuation-in-part of commonly assigned U.S. utility patent application Ser. No. 11/238,371, filed Sep. 29, 2005, now abandoned, of the same inventive entity as herein, both of which are incorporated herein by reference in their entirety.

TECHNICAL FIELD

The present invention relates to roof underlayments and more particularly, to heavyweight and lightweight underlayment products which utilizes a rubberized asphalt layer.

BACKGROUND INFORMATION

An underlayment material is commonly used in a number of roofing applications as well as other underlayment situations. The typical product utilized in roofing underlayment is commonly referred to as "tar" of "felt" paper. The traditional "tar paper" is an asphalt impregnated paper product which is sold in a roll; unrolled on a roof; cut to length; and fastened to the roof utilizing staples or nails. Although tar paper is inexpensive, it does not seal nail holes through the paper and thus does not prevent water infiltration. In addition, once the felt is rolled out, it absorbs water and once wet, it wrinkles and expands, and must be allowed to dry out before covering with shingles. Other prior art shingle underlayment products also suffer from the same problems.

Accordingly, what is needed are generally low cost, heavyweight or lightweight, dimensionally stable underlayment products on which the installer can walk, without sticking or slipping, which will not slide underfoot and which will cold flow and/or elongate and recover to seal nail holes and other punctures. In addition, such products should be dimensionally stable, resist tearing, non-adhesive to other layers, and provide hot and cold flexibility.

SUMMARY

The present invention features novel underlayment products which will be relatively inexpensive and replace prior art products such as "tar paper" or "felt paper". The present invention provides underlayment products with a top surface that can be walked on and will not slide under foot, and wherein the products will not stick to themselves or the roof. In addition, the present invention has "cold" flow properties which allow it to "repair" or "heal" itself to thereby reseal around nail or puncture holes and also elongate and recover around punctures.

In accordance with one embodiment of the present invention, the underlayment includes an underlayment membrane comprising a fibrous mat having an upper surface and a lower surface. An elastomeric asphalt coating is applied to the lower surface of the fibrous mat and at least partially or fully infiltrates and saturates the fibrous mat. Next, an oxidized asphalt coating is applied to both the upper and lower surfaces of the fibrous mat, thereby essentially encapsulating the fibrous mat.

The underlayment membrane may further include a release coating applied to the oxidized asphalt coating on either the upper and/or lower surface of the fibrous mat. The release coating includes, in one embodiment, a talc/water coating but may alternatively include granule particles applied proximate at least the oxidized asphalt coating proximate said upper surface of said fibrous mat.

The release coating may include a polymeric coating applied on at least the upper surface of the fibrous mat while the polymeric coating may be provided with a coating of finally-ground mineral, such as talc and finely-ground granules.

In the preferred embodiment, the rubberized asphalt coating which is applied from the bottom of the mat and partially or fully infiltrates the fibrous mat includes approximately 48% flux asphalt, 2% radial SBS rubber and 50% filler material while the fibrous mat includes fibers selected from the group consisting of polyesters, polypropylenes and fiberglass. The coating may, however, be provided having a range a ingredients including, but not limited to 0.5% to 12% radial or linear rubber or polymer; 0-70% filler; and 48-98% asphalt including 0-70% oxidized asphalt. The filler affects the walkability of the outer surface. If the filler content is too low such that a higher asphalt percentage exists, the product would be sticky. The high filler content and/or talc layer prevents sticking. In addition, the filler also brings down the price of the finished product.

Adding an oxidized asphalt layer on both the top and bottom layer of the mat makes the product more usable in hotter conditions providing a higher resistance to softening by providing an asphalt with a higher Ring and Ball softening point temperature. It also makes the product not stick in three ways: 1) foot traffic 2) the roof deck and 3) in the roll form.

The rubber or other elastomer in the elastomeric layer may be linear or radial rubber although with linear SBS rubber, as much as 10 or 12 percent may be required whereas with radial SBS rubber, 0.5 to 6% will generally suffice.

In the preferred embodiment, the talc coating is suspended in a water-based, polymer emulsion. Examples of the polymer include styrene, acrylic and the polyurethane. When it dries, the polymer forms a film which helps hold the talc to the asphalt so that the talc does not fall off or interfere with any overlap or bonding areas. Loose talc is a slip problem. Although a talc acrylic layer is preferred as the method to prevent sticking, a water or other based polymer may be applied and may be sufficient, as would be a plastic film.

In accordance with another embodiment of the present invention, the underlayment includes an underlayment membrane comprising a fibrous mat having an upper surface and a lower surface. An elastomeric asphalt coating is applied to the upper surface of the fibrous mat and at least partially or fully infiltrates and saturates the fibrous mat. Next, an oxidized asphalt coating is applied in one embodiment to the lower surface of the fibrous mat.

The underlayment membrane may further include a release coating applied to the oxidized asphalt coating on the lower surface of the fibrous mat. In an alternate embodiment without the oxidized asphalt layer, the release coating is applied to the lower surface of the fibrous mat. The release coating includes, in one embodiment, a talc/polymer coating.

The underlayment membrane may further include a split release facing having a high traction surface that is applied to the rubberized asphalt coating on the upper surface of the fibrous mat. The split release facing having a high traction surface, in one embodiment, provides a selvedge edge and includes a plurality of separate and distinct regions bearing a high traction polymer blend.

In the preferred lightweight underlayment embodiment, the rubberized asphalt coating which is applied onto the top of the mat and partially or fully infiltrates the fibrous mat includes approximately 48% flux asphalt, 2% radial SBS rubber and 50% filler material while the fibrous mat includes fibers selected from the group consisting of polyesters, polypropylenes and fiberglass. The coating may, however, be provided having a range a ingredients including, but not limited to 0.5% to 12% radial or linear rubber or polymer; 0-70% filler; and 48-98% asphalt including 0-70% oxidized asphalt. The filler affects the walkability of the outer surface. If the filler content is too low such that a higher asphalt percentage exists, the product would be sticky. The high filler content and/or talc layer prevents sticking. In addition, the filler also brings down the price of the finished product.

The rubber or other elastomer in the elastomeric layer may be linear or radial rubber although with linear SBS rubber, as much as 10 or 12 percent may be required whereas with radial SBS rubber, 0.5 to 6% will generally suffice.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by allowed claims.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention features novel underlayment products which will be relatively inexpensive and replace prior art products such as "tar paper" or "felt paper". The present invention provides underlayment products with a top surface that can be walked on and will not slide under foot, and wherein the products will not stick to themselves or the roof. In addition, the present invention has "cold" flow properties and elongate and recovery properties which allow it to reseal around nail or puncture holes.

Figure 1:
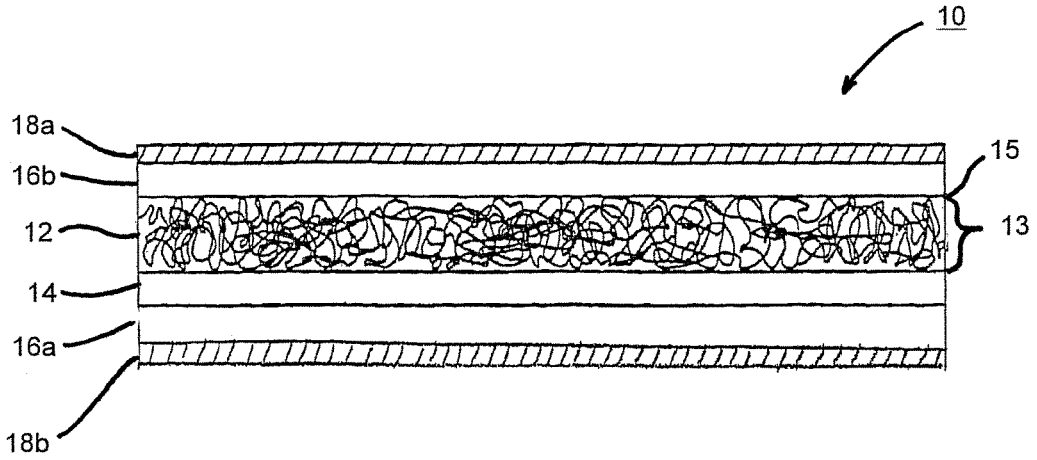
FIG. 1 is a schematic sectional view of the heavyweight underlayment of the present invention.

The heavyweight underlayment 10, FIG. 1, in accordance with the present invention includes a fibrous mat 12 disposed in the center of the underlayment. Examples of and equivalents for the fibrous mat 12 are disclosed in U.S. Pat. Nos. 6,531,200 and 6,296,912 assigned to the assignee of the present invention and incorporated fully herein by reference.

The fibrous mat 12 is first coated proximate one side with a rubberized asphalt layer 14. The rubberized asphalt layer 14 typically comprises approximately 4% rubber, 46% flux asphalt and 50% filler, although various percentages may be provided. These percentages are approximate and those skilled in the art would understand that a deviation from these percentages is considered within the scope of the present invention.

The rubberized asphalt layer 14 exhibits "cold flow" or "self-healing" properties by virtue of the inclusion of a relatively small percentage of rubber. Accordingly, when the underlayment 10 is punctured, such as by a nail, the rubberized asphalt layer 14 will "self-heal" around the puncture thereby resealing around the puncture. This is particularly important when underlayment is used under roofing tile in which case the tiles are fastened to the roof using "ring" nails which create a hole which is larger than the nail shank itself. In this case, the rubber in the underlayment will actually stick to the ridges in the nail shank and stretch around the nail shank thereby creating a generally watertight seal around the shank of the nail. Without the "self-healing" properties of the rubberized asphalt layer 14 of the underlayment 10 of the present invention, persistent roof leaks abound.

In the preferred embodiment, the rubber includes "SBS" radial rubber although linear rubber, in a higher content percentage, would also be acceptable. The SBS rubber is mixed with the flux asphalt using a high shear mill, as is well known in the art. The rubberized asphalt layer 14 is applied to only one side of the fibrous mat 12. This one-sided application serves to vaporize and drive out any moisture trapped in the fibrous mat 12. Examples of how to coat fibrous mats on one side can be found in the two referenced United States patents previously fully incorporated by reference.

The rubberized asphalt layer 14 infiltrates at least partially but also can extend fully into the central region 13 of fibrous mat 12.

After the application of the rubberized asphalt layer 14 to one side of the fibrous mat 12, oxidized asphalt layers **16*a* and 16*b* are applied; with oxidized asphalt layer 16*a* applied over the rubberized asphalt layer 14 while the oxidized asphalt layer 16*b* is applied directly to the fibrous mat on the side opposite the rubberized asphalt layer 14. Accordingly, in the preferred embodiment, the interface between the rubberized asphalt layer 14 and the oxidized asphalt layer 16*b* will occur in region 13 of fibrous mat 12 and not proximate or on the upper surface 15 of fibrous mat 12. If the interface between the oxidized asphalt layer 16*b* and the rubberized asphalt layer 14 is proximate or at the upper surface 15 of fibrous mat 12, the oxidized asphalt layer 16** exhibits a tendency to slip or shear away from the rubberized asphalt layer particularly due to foot traffic when the product was installed on a hot roof. This presents a dangerous situation and also one where the product would have a tendency to adhere to an adjacent layer.

As is well known in the prior art, an oxidized asphalt layer typically includes approximately 50% oxidized asphalt and 50% filler. The oxidized asphalt layer **16*b* will become the top surface of the underlayment 10. Since there is no rubberized asphalt layer under the oxidized asphalt layer 16*b*, anyone walking on this product will not slip given the propensity of oxidized asphalt layer to break away from the rubberized asphalt layer if the rubberized asphalt later were located directly beneath the top oxidized asphalt layer and not within the fibrous mat 12**.

Finally, the top and bottom of the underlayment 10 is coated with a talc acrylic layer 18. The talc acrylic layer 18 provides an additional coating to the oxidized asphalt layers, filling in any voids that are present and preventing the membrane from sticking to itself when the rolled. The talc layer 18 is applied as a talc/water or talc polymer mixture as described, for example, in U.S. Pat. No. 6,531,200. In an alternative embodiment, talc layer 18*a* may be replaced with or include granular particles.

Figure 2:
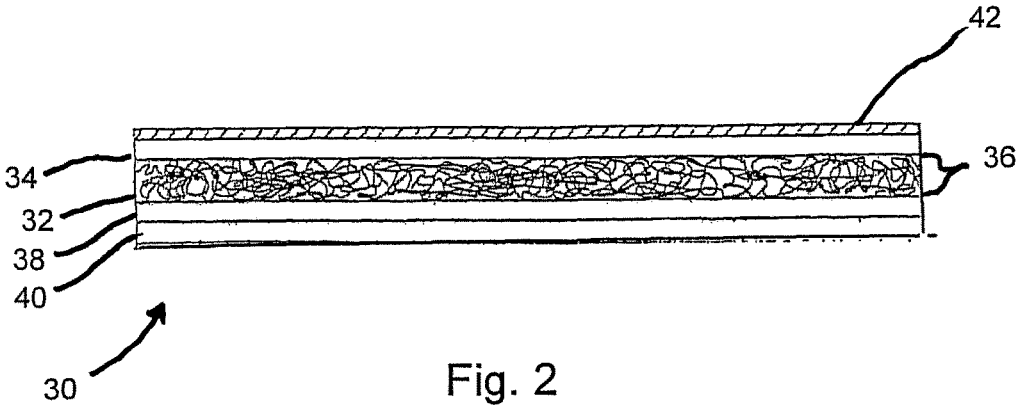
FIG. 2 is a schematic sectional view of the lightweight underlayment of the present invention.

The lightweight underlayment 30, FIG. 2, in accordance with the present invention includes a fibrous mat 32 disposed in the center of the underlayment. Examples of and equivalents for the fibrous mat 32 are disclosed in U.S. Pat. Nos. 6,531,200 and 6,296,912 already incorporated by reference hereinabove. The fibrous mat 32 is first coated proximate its upper side with a rubberized asphalt layer 34. The rubberized asphalt layer 34 typically comprises approximately 4% rubber, 46% flux asphalt and 50% filler, although various percentages may be provided. These percentages are approximate and those skilled in the art would understand that a deviation from these percentages is considered within the scope of the present invention.

The rubberized asphalt layer 34 exhibits "cold flow" or "self-healing" properties by virtue of the inclusion of a relatively small percentage of rubber. Accordingly, when the underlayment 30 is punctured, such as by a nail, the rubberized asphalt layer 34 will "self-heal" around the puncture thereby resealing around the puncture. This is particularly important as discussed above when underlayment is used under roofing tile in which case the tiles are fastened to the roof using "ring" nails which create a hole or puncture which is larger than the nail shank itself.

In the preferred embodiment, the rubber includes "SBS" radial rubber although linear rubber, in a higher content percentage, would also be acceptable and is contemplated. The SBS rubber is mixed with the flux asphalt using a high shear mill, as is well known in the art. The rubberized asphalt layer 34 as for the embodiment 10 described hereinabove is applied to only one side of the fibrous mat 32, which serves to vaporize and drive out any moisture trapped in the fibrous mat 32. Examples of how to coat fibrous mats on one side can be found in the two referenced United States patents previously fully incorporated by reference.

The rubberized asphalt layer 34 infiltrates at least partially but also can extend fully into the central region 36 of fibrous mat 32.

After the application of the rubberized asphalt layer 34 to the top of the fibrous mat 32, an oxidized asphalt layer 38 in one embodiment is applied directly to the fibrous mat underside opposite the rubberized asphalt layer 34. As is well known in the prior art, an oxidized asphalt layer typically includes approximately 50% oxidized asphalt and 50% filler.

The bottom of the underlayment 30 is coated with a talc acrylic layer 40. The talc acrylic layer 40 provides an additional coating to the oxidized asphalt layer 34, filling in any voids that are present and preventing the membrane from sticking to itself when rolled. In an alternate embodiment, the oxidized asphalt layer 38 is not used, and the talc acrylic layer 40 is applied directly to the underside of the fibrous mat 32. The talc acrylic layer 40 in either embodiment is applied as a talc/water or talc polymer mixture as described, for example, in U.S. Pat. No. 6,531,200.

Figure 3:
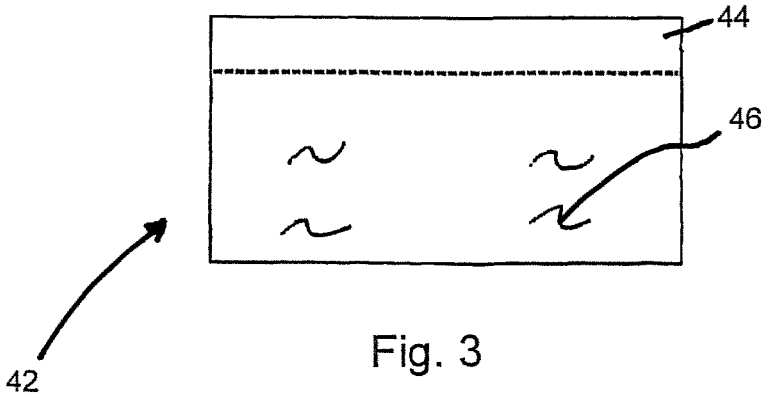
FIG. 3 is a schematic top plan view of the lightweight underlayment of the present invention.

The top of the underlayment 30 is coated with a split release facer having high traction surface generally designated 42. As best seen in FIG. 3, the facer 42 is segmented to include a first removable selvedge edge segment 44 and a second segment providing a high traction surface schematically illustrated at 46. As will be readily appreciated by those of skill in the art, removal of the selvedge edge segment 44 exposes the adhesive surface of the rubberized asphalt, which provides adhesion of successive courses to each other, the exposed rubberized adhesive edge of one course to the talc/polymer layer of another partially overlapping course. Any suitable facer adapted to provide a removable selvedge edge while preventing or reducing self-adhesion when rolled, such as facers provided with partially overlapping edge portions, or with underlay strips as in U.S. Pat. No. 5,916,654 to Phillips et al., incorporated herein by reference, or with pull strings as in U.S. Pat. No. 6,235,364 to Schaughency et al., incorporated herein by reference, or laser slit as disclosed in commonly assigned and co-pending U.S. utility patent application Ser. No. 11/749,360, filed on May 16, 2007, entitled Self-adhesive Product Having a Laser Slit Release Liner and Method of Making Same, incorporated herein by reference, may be employed.

The high traction portion 46 preferably is formed of one or more separate and distinct polymer regions disposed on the upper side of the facer 42 that is softer than the material substratum of the facer 42 to provide a high traction surface. The high traction polymer regions may be arranged in any suitable pattern, such as strips, or dots. In one presently preferred embodiment, the high traction polymer is arranged in spaced-apart longitudinally extending strips on a 0.5 mil or 0.25 mil polyethylene film and is fabricated of a blend comprising a mixture of low molecular weight polyethylene and amorphous polyolefin, as disclosed in commonly assigned U.S. Pat. No. 6,385,934 to Zickell et al., incorporated herein by reference.

Accordingly, the present invention provides novel and useful underlayment products which can be used under many roofing or other materials as a substrate or underlayment, which serves to self-seal around any penetrations such as nails and the like.

As mentioned above, the present invention is not intended to be limited to a system or method which must satisfy one or more of any stated or implied object or feature of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. An underlayment membrane comprising:

a fibrous mat having an upper surface and a lower surface extending longitudinally between first and second ends;

a rubberized asphalt coating applied to the upper surface of the fibrous mat and extending at least partially into said fibrous mat, said rubberized asphalt coating comprising 0.5% to 12% radial or linear rubber or polymer, 0% to 70% filler, and 48% to 98% asphalt;

an oxidized asphalt coating applied to said lower surface of said fibrous mat; and a split facer sheet applied directly to said rubberized asphalt coating applied to the upper surface of the fibrous mat to define a top portion of the underlayment membrane, the split facer sheet comprising a polymeric film segmented along a longitudinal axis to separate the polymeric film into first and second coplanar segments of the split facer sheet, the first segment comprising a removable selvedge edge segment removable to expose an underlying portion of the rubberized asphalt coating to allow partial overlapping of successive courses during installation and the second segment comprising a plurality of spaced apart and distinct traction surface regions applied to an upper side of the polymeric film that are softer than a material substrate of the split facer layer so as to reduce if not eliminate applicator slippage during installation.

2. The underlayment membrane of claim 1 further including a release coating applied to said lower surface of said fibrous mat.

3. The underlayment membrane of claim 2 wherein said release coating includes a talc/polymer coating.

4. The underlayment membrane of claim 1 further including a release coating applied to said oxidized asphalt coating applied to said lower surface of said fibrous mat.

5. The underlayment membrane of claim 4 wherein said release coating includes a talc/polymer coating.

6. The underlayment membrane of claim 1 wherein said split facer sheet is comprised of a polymeric substrate disposed as a coating on said rubberized asphalt coating provided on said fibrous mat.

7. The underlayment membrane of claim 6 wherein each of said plurality of spaced apart and distinct traction surface regions applied to the material substrate of the split facer sheet is comprised by a polymer blend including a mixture of low molecular weight polyethylene and amorphous polyolefin.

8. The underlayment membrane of claim 1 wherein the fibrous mat includes fibers selected from the group consisting of polyesters, polypropylenes and fiberglass.

* * * * *